US005681148A

United States Patent [19]

Friedman et al.

[11] Patent Number: 5,681,148

[45] Date of Patent: Oct. 28, 1997

[54] VACUUM/HOLDING TANK

[75] Inventors: William J. Friedman, Big Prairie; James A. Sigler, Perrysville; Edward McKiernan, Big Prairie, all of Ohio

[73] Assignee: Sealand Technology, Inc., Big Prairie, Ohio

[21] Appl. No.: 551,029

[22] Filed: Oct. 31, 1995

[51] Int. Cl.[6] ..... F04B 49/00

[52] U.S. Cl. ..... 417/36; 417/53; 4/431

[58] Field of Search ..... 417/18, 36, 53; 4/321, 323, 431, 417, 432, 433, 434

[56] References Cited

U.S. PATENT DOCUMENTS

| | | | |
|---|---|---|---|
| 3,663,970 | 5/1972 | Drouhard, Jr. et al. . | |
| 3,727,241 | 4/1973 | Drouhard, Jr. et al. . | |
| 3,811,135 | 5/1974 | Drouhard, Jr. et al. . | |
| 4,672,690 | 6/1987 | Sigler | 4/423 |
| 4,819,279 | 4/1989 | Sigler . | |
| 4,865,631 | 9/1989 | Stroby et al. | 55/163 |
| 5,002,592 | 3/1991 | Stroby et al. | 55/169 |
| 5,139,655 | 8/1992 | Sigler . | |
| 5,214,807 | 6/1993 | Terve . | |
| 5,345,618 | 9/1994 | Sigler | 4/321 |
| 5,408,704 | 4/1995 | Bailey et al. . | |

FOREIGN PATENT DOCUMENTS 4112888 10/1991 Germany .

*Primary Examiner*—Timothy Thorpe
*Assistant Examiner*—Xuan M. Thai
*Attorney, Agent, or Firm*—Nixon & Vanderhye P.C.

[57] ABSTRACT

A sewage handling assembly particularly for boats and recreational vehicles with a minimum of components. The waste discharge of a toilet is connected to an inlet for a combined vacuum and holding tank which mounts a vacuum pump, and optionally mounts a sewage discharge pump. A sewage discharge conduit, which may be connected to the optional sewage discharge pump, is connected to a first outlet from the tank, in turn connected to a dip tube terminating in an open end just above the tank bottom. A second outlet from the tank is connected to the vacuum pump (in turn connected to a gas conduit with an end termination penetrating an exterior partition of the boat or RV), and an upwardly extending gas tube inside the tank, having an opening near the interior top of the tank, is connected to the second outlet. The tank is controlled so that a gas volume of about 2 and ½–4 gallons is always maintained in the tank, with a vacuum level of between about 8–10 inches of mercury. Once the volume of sewage in the tank reaches a predetermined level—so that sewage might be inadvertently withdrawn by the vacuum pump—the vacuum pump is controlled so that it will not operate until the tank is emptied (or the sewage level otherwise reduced).

23 Claims, 5 Drawing Sheets

Fig. 1
PRIOR ART
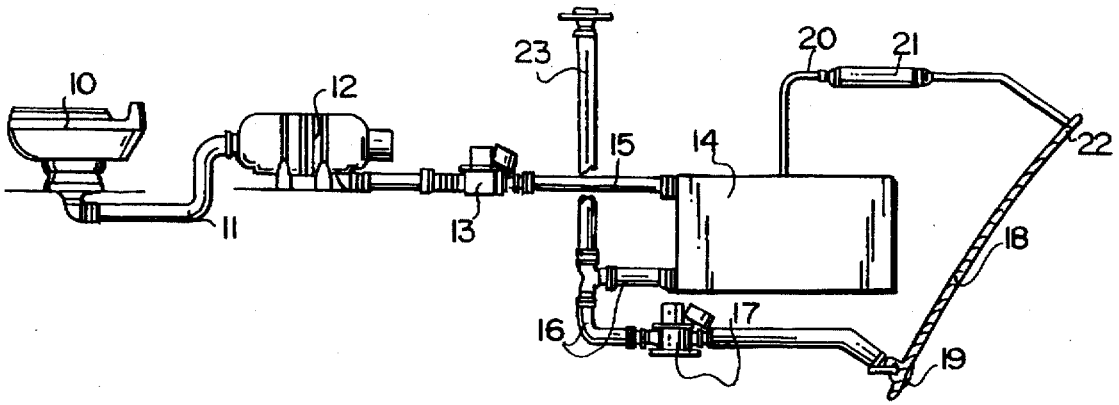
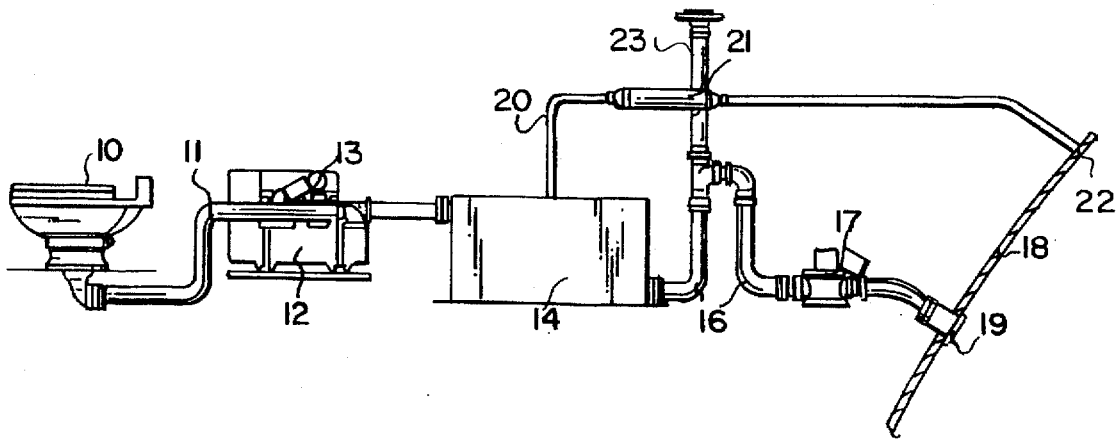
Fig. 2

Fig. 7
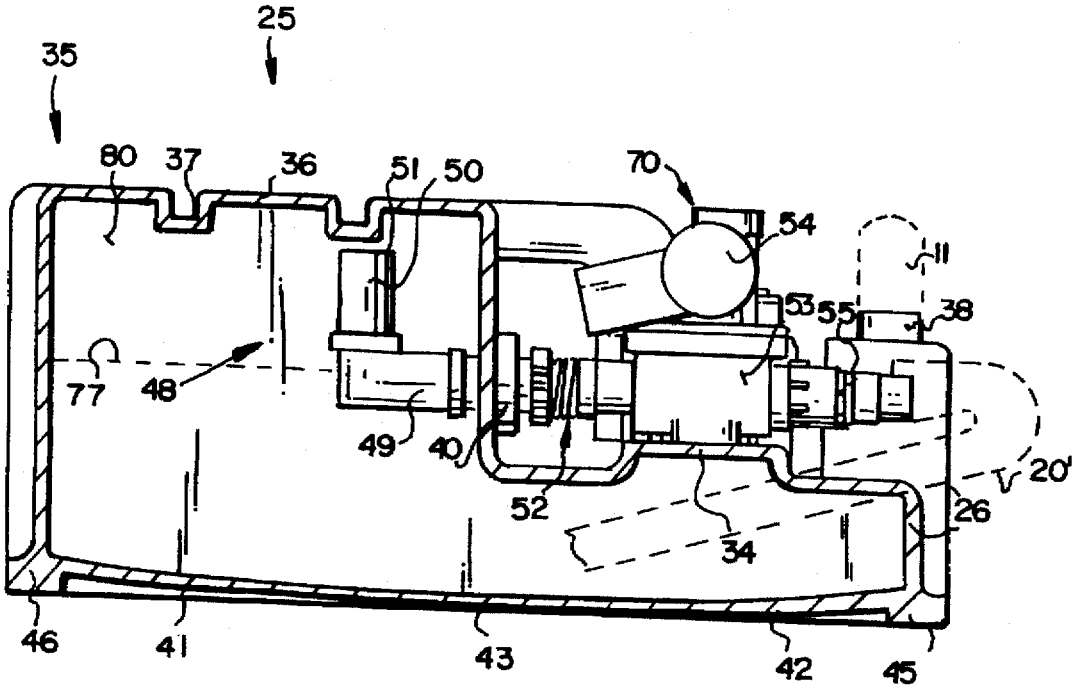
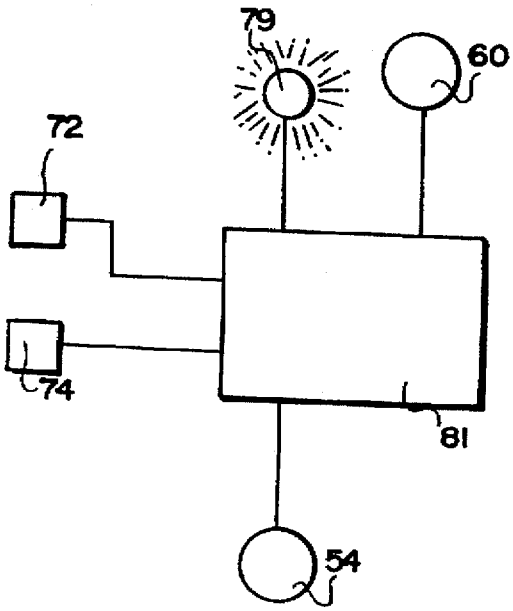
Fig. 9

VACUUM/HOLDING TANK

BACKGROUND AND SUMMARY OF THE INVENTION

The "VACU-FLUSH"® toilet system for boats and recreational vehicles manufactured by Sealand Technology, Inc. of Big Prairie, Ohio, has for many years effectively provided a vacuum system facilitating flushing of a vacuum toilet and holding of the sewage from the toilet until there is a need or opportunity to properly dispose of it. Initially, this system included four main components, a vacuum toilet connected to a vacuum tank, in turn connected to a vacuum pump, in turn connected to a holding tank, such as shown in U.S. Pat. No. 4,819,279. The number of components was effectively reduced from four to three by efficiently combining the vacuum pump with the vacuum tank, such as shown in U.S. Pat. No. 5,408,704 and co-pending application Ser. No. 08/484,843 filed Jun. 7, 1995 (the disclosures of which are both hereby incorporated by reference herein). The invention relates to a still further development of such a toilet system which is particularly suitable for use in boats or recreational vehicles where space is at a premium or where relevant cost factors apply. According to the present invention the vacuum tank and holding tank are combined, and also mount the vacuum pump. This means that the system has a minimum number of components (two), a vacuum toilet and a combined vacuum/holding tank and vacuum pump. While the number of components have been reduced according to the invention, the functionality of the system is not in any way, shape or form compromised. Rather only cost saving, space saving, and operational advantages ensue.

According to one aspect of the present invention a combined vacuum and holding tank assembly is provided comprising the following components: A substantially hollow tank having first and second ends, first and second sides, at least one pump-mounting surface, first and second outlets, an inlet, a raised portion having an upper surface, and a bottom. A vacuum pump mounted on the at least one pump-mounting surface exteriorly of the tank. A downwardly extending tube disposed within the tank connected to the first outlet. A gas inlet tube disposed within the tank and connected to the second outlet, and having a top open end adjacent (i.e. near) the tank upper surface. A connection between the vacuum pump and the second outlet exterior of said tank. A sensor for sensing the level of liquid in the tank. And, means for precluding operation of the vacuum pump if the sensed level within the tank becomes closer than a predetermined amount to the air inlet tube open top end so that a gas volume is always provided adjacent the upper surface inside the tank.

The means for precluding operation of the vacuum pump if the sensed level within the tank rises too high ensures that sewage doesn't pass out the vacuum pump (which is usually capable of pumping liquid too). For example in typical operation, the tank would have a waste holding capacity of about 10 to 11 gallons, and operate with a minimum of about three gallons of vacuum, which is generated to between 8–10 inches of mercury (as is conventional per se). In response to the sensing of the level of the waste, a relay may be closed or opened to detach the vacuum pump from its power source so that it can no longer operate until the liquid level drops, or a controller may be provided to take information from the sensor and disable the vacuum pump in any known manner. The sensor too may be any conventional structure, such as an optical, sonar (including ultrasound), piezoelectric, fluidic, or mechanical sensor. For example a conventional float operated sensor can be utilized.

Typically a gas discharge tube is connected to the vacuum pump for discharging gas from the tank, e.g. penetrating an exterior partition wall of a boat (e.g. boat hull) or recreational vehicle (e.g. side panel or bottom) in which the tank is mounted, and a conduit is typically connected to the first outlet for discharging sewage from the tank. Typically the at least one pump-mounting surface comprises a top surface, and includes a second pump-mounting top surface. In that case an optional sewage discharge pump may be mounted on the second pump-mounting top surface and connected to the first outlet. A conduit is preferably provided connecting the inlet to at least one vacuum toilet.

Typically the tank is plastic, e.g. rotational molded from linear low density polyethylene, although a wide variety of other plastics may be utilized, and other manufacturing techniques. Rotational molding is preferred, however, since it is easy and inexpensive. Where made out of plastic, the tank typically has reinforcing grooves formed in the raised portion, and has no continuous flat surface area of more than 80 square inches. Also the first and second outlets are typically on opposite sides of a vertical plane substantially bisecting the tank and intersecting the first and second ends thereof, and face in opposite directions.

A vacuum switch is mounted to the tank for sensing the level of vacuum in the gas volume. Any conventional construction of vacuum switch, or like device, may be utilized, the details of the vacuum sensing not being significant. Typically the vacuum switch is calibrated to start operation of the pump if the level of vacuum in the gas volume is lower than a predetermined amount (e.g. if lower than about eight inches of mercury the vacuum pump is operated until the gas volume is evacuated to a level of about ten inches of mercury).

Typically the bottom of the tank is formed with a slope toward a sump, and integral plastic legs support the tank on a horizontal surface so that the sump is the lowest part of the tank. The downwardly extending tube preferably comprises a dip tube having an end termination cut at an angle, defining a generally oval-shaped opening disposed just above the sump. In this manner the general configuration of the tank bottom and the dip tube configuration are such as illustrated in U.S. Pat. application Ser. No. 08/484,843 filed Jun. 7, 1995 (already incorporated by reference herein).

According to another aspect of the present invention a method of operating a vacuum toilet, using a combined vacuum and holding tank connected to the toilet, and a vacuum pump, is provided. The method comprises the following steps: (a) Providing a vacuum in at least an upper gas volume of the tank. (b) Flushing the toilet so as to connect the toilet to the vacuum in the upper gas volume so that sewage from the toilet flows into the tank, establishing a sewage level in the tank. (c) Sensing the level of vacuum in the tank. (d) When the level of vacuum drops below a predetermined level as determined by step (c), operating the vacuum pump to raise the level of vacuum above the predetermined level. (e) Sensing the sewage level in the tank. (f) When the sewage level becomes higher than a predetermined amount, precluding operation of the vacuum pump until the sewage level is lowered. And, (g) when necessary, emptying the sewage from the tank directly to a treatment or disposal site.

Step (d) is typically practiced to start the vacuum pump when the level of vacuum drops to about eight inches of mercury, and to stop operation once the level reaches about ten inches of mercury. The tank is typically rotational molded of plastic, and step (g) is practiced without applying positive air pressure to the tank. Step (g) may be practiced by connecting the conduit from the tank to a pump-out station located at a dock or campsite, or by operating an optional sewage discharge pump mounted on the tank, or in other known manners.

According to another aspect of the present invention a sewage handling assembly is provided for a boat, RV, plane or train comprising the following components: At least one toilet having a waste discharge therefrom. A plastic combined vacuum and holding tank including an inlet and first and second outlets. A conduit connecting the tank inlet to the toilet waste discharge. A vacuum pump connected to the second outlet. A gas handling conduit from the vacuum pump including an end termination penetrating the boat, plane, train or recreational vehicle exterior partition. A sewage handling conduit operatively connected to the first outlet and having an end termination penetrating the partition. And, the tank having a top and a bottom, sewage from the toilet provided in the bottom, and gas at less than atmospheric pressure provided in the top at all times. The details of the tank, etc., preferably are as described above.

It is the primary object of the present invention to provide the optimum in simplicity and cost effectiveness for the handling of sewage from one or more vacuum toilets, particularly in association with boats, recreational vehicles, planes, trains, and other vehicles. This and other objects of the invention will become dear from an inspection of the detailed description of the invention and from the appended claims.

BRIEF DESCRIPTION OF THE DRAWINGS

FIG. 1 is a side schematic view of a conventional prior art VACU-FLUSH® sewage handling system for a boat, RV, or the like;

FIG. 2 is a view like that of FIG. 1 showing the simplified system of co-pending application Ser. No. 08/484,843;

FIG. 7 is a view like that of FIG. 5 only taken along lines 7—7 of FIG. 4;

FIG. 9 is an exemplary control schematic for the system of FIG. 3.

DETAILED DESCRIPTION OF THE DRAWINGS

Figure 3:
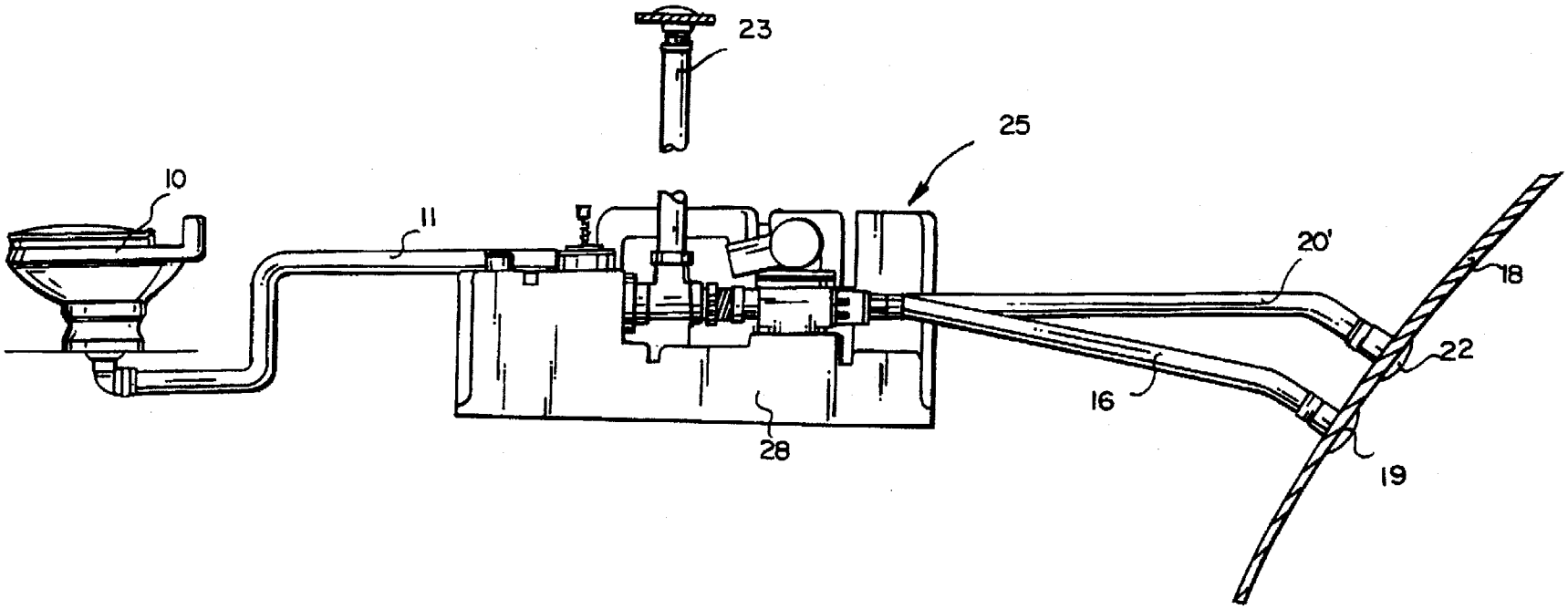
FIG. 3 is a view like that of FIGS. 1 and 2 of the still further simplified system according to the present invention.

In the conventional VACU-FLUSH® system as illustrated in FIG. 1, at least one vacuum toilet 10 having a waste discharge on the bottom thereof is connected by a conduit 11 (typically a flexible hose) to a vacuum tank 12. A vacuum level of about 8–10 inches of mercury is maintained in the tank 12 by the vacuum pump 13, a conventional vacuum switch on the tank 12 operating the pump 13 to maintain an appropriate vacuum. When the pump 13 is operated to replenish the vacuum in the vacuum tank 12, sewage is pumped to the holding tank 14 via conduit 15. The sewage ultimately is discharged from the holding tank 14 via conduits 16 perhaps by using an optional sewage discharge pump 17 which is operated only when there is a mechanism for proper disposal of the sewage. The exterior partition 18 in FIG. 1 comprises an exterior partition of a boat, recreational vehicle, plane, train, or other vehicle, e.g. simulating the form of boat hull in the actual illustration in FIG. 1. The exterior partition 18 is penetrated by termination 19 of the conduit 16 from the tank 14. When the pump 17 is not used the termination 19 is merely connected up to a pump-out facility at a dock, campsite, terminal, or the like. Conventional valves are provided to preclude sewage from being discharged from the tank 14 into conduit 16 unless there is a motive force appropriate for discharging the sewage to a suitable location.

From the holding tank 14 is a conventional vent 20, which may have a suitable filter therein such as shown in U.S. Pat. No. 5,139,655 (the disclosure of which is hereby incorporated by reference herein), with an end termination 22 of the conduit 20 penetrating the partition 18 to vent odoriferous gases from the holding tank 14 to the atmosphere. Another conventional vent 23 is typically also provided from the conduit 16, typically penetrating another partition (e.g. boat deck) of the vehicle in which the toilet 10 is provided.

FIG. 2 illustrates a system according to co-pending application Ser. No. 08/484,843. In this system components comparable to those in the FIG. 1 embodiment are shown by the same reference numeral. Note that in this case the vacuum tank 12 and the vacuum pump 13 have been combined, thus reducing the number of major components by one compared to the system of FIG. 1.

FIG. 3 schematically illustrates a system according to the present invention. In FIG. 3 components comparable to those in FIG. 1 are shown by the same reference numeral. Note, however, that in this embodiment the vent tube 20' is shown slightly different in configuration, and without a filter, although a filter may be provided. In the system of FIG. 3 the only two major components are one or more vacuum toilets 10 and the combined vacuum/holding tank (mounting the vacuum pump) 25.

Figure 4:
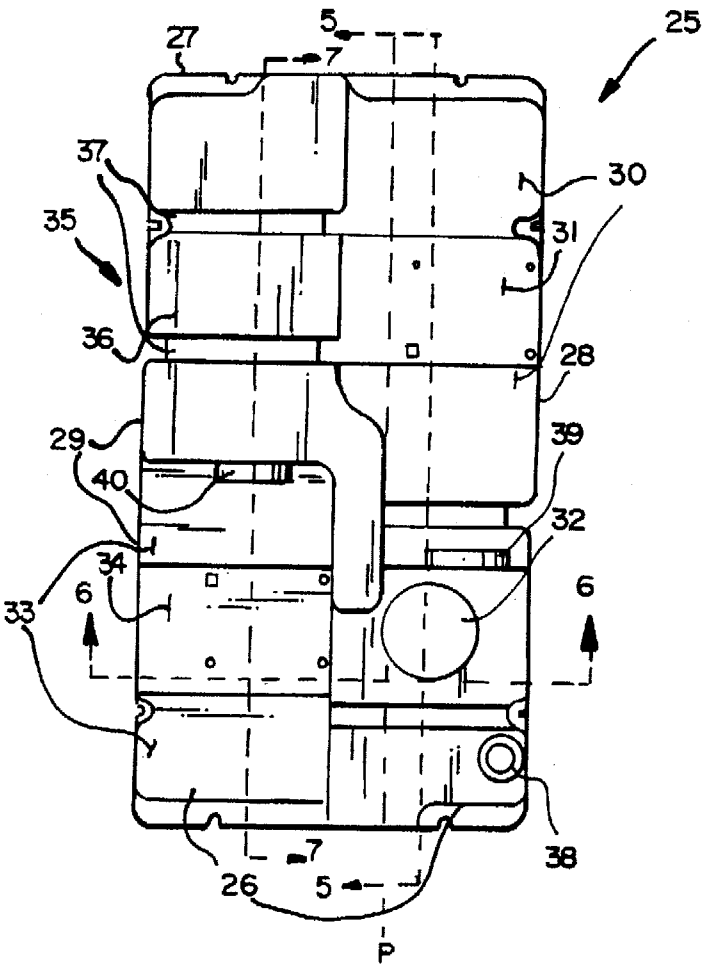
FIG. 4 is a top plan view of the tank (alone) of the system of FIG. 3.

FIG. 4 is a top plan view of the tank 25 per se. Note that the tank 25 has first and second end walls 26, 27 and first and second side walls 28, 29, the side wall 28 being seen in FIG. 3. It also includes top surfaces 30 adjacent the side wall 28 with a top pump-mounting surface 31, and a raised portion 32. On the opposite side of the tank 25 from the surfaces 30–32 (e.g. on the other side of an imaginary vertical plane P substantially bisecting the tank 25 and intersecting the end walls 26, 27) are the top surfaces 33, with another pump-mounting top surface 34 therebetween. Also provided is a raised portion shown generally by reference numeral 35, which includes an upper surface 36 with reinforcing grooves 37 formed therein. Also seen in FIG. 4 are an inlet 38 to the hollow interior of the tank 25, a first outlet 39, and a second outlet 40. Note that the outlets 39, 40 are on opposite sides of the plane P and face in opposite directions. All of the components 38–40 preferably are substantially circular in cross-section and are adapted to be readily connected to various conduits, pumps, or other fluid transmitting elements.

The tank 25—as clearly illustrated in all of the drawings—has a number of irregularities in the surface thereof. These irregularities are provided so that there is no flat continuous surface of the tank 25 which is greater than eighty square inches in area. This allows the tank 25 to be made of plastic and still function properly. For example the tank 25 may be inexpensively and easily made by conventional rotational molding techniques from a wide variety of plastics. One particularly desirable plastic is linear low density polyethylene, although other plastics may be utilized.

Figure 8:
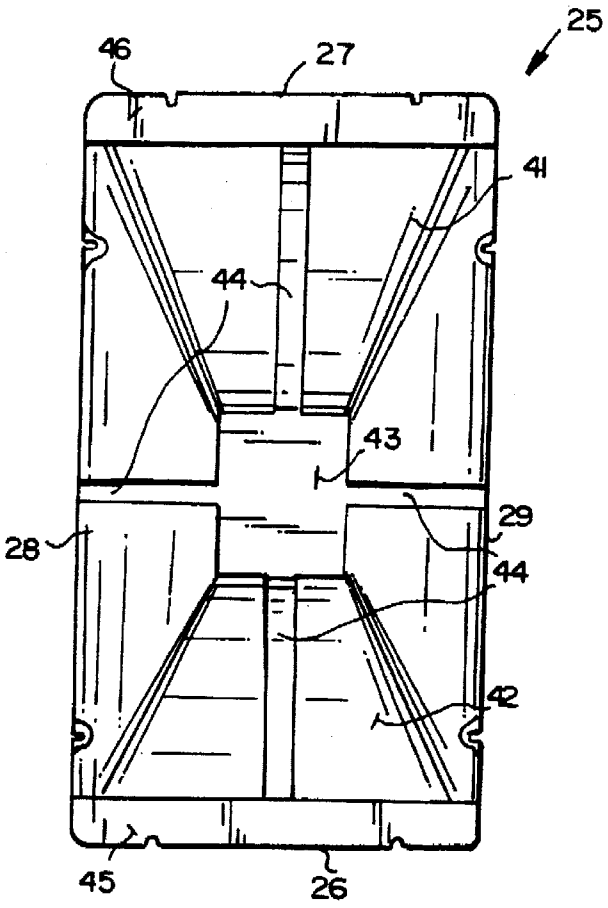
FIG. 8 is a bottom plan view of the tank of FIG. 4.

As seen in FIG. 8 the bottom of the tank 25 preferably comprises downwardly sloping surfaces 41, 42 which meet at a sump 43 in a somewhat central location in the bottom, and stiffening ribs 44 preferably are provided integrally molded with the tank surface portions forming the bottom. Integrally formed feet 45, 46 are preferably provided at the ends 26, 27, respectively, of the tank 25 bottom and support the tank 25 on a substantially horizontal surface so that the sump 43 is the bottom-most portion of the tank 25 during normal use.

FIG. 7 shows the tank 25 particularly as associated with the vacuum pump and related components. Connected to the second inlet 40 is a gas inlet tube shown generally by reference numeral 48. The gas inlet tube 48 may have almost any suitable configuration; the configuration specifically illustrated in FIG. 7 is a generally horizontally extending component 49 from which a generally vertically extending component 50 projects upwardly having an open end 51 adjacent the interior of the upper surface 36 of the tank 25 raised portion 35. The opening 51 is preferably placed as close to the highest interior surface of the tank 25 as possible (e.g. from about 0.1 to 1.5 inches), while still allowing ready flow of air and other gas therein to, in order to minimize the possibility that sewage will splash into or otherwise enter the open end 51. If splashguards, or the like, are used, the spacing may be further than if not used, and if used in a system which does not move (as does a boat), the spacing also can be greater.

Mounted on the surface 34 is a vacuum pump 53 of conventional construction (comparable to the pumps 13 in FIGS. 1 and 2). The vacuum pump 53 is typically driven by an electric motor 54, although any suitable conventional type of vacuum pump drive may be utilized. Any conventional suitable connection (a screw connection being illustrated in the exemplary embodiment illustrated in FIG. 7) 52 may be provided connecting the outlet 40 to the vacuum pump 53, and a discharge conduit 55 from the vacuum pump 53 is typically connected to the conduit 20', as illustrated in dotted line in FIG. 7. FIG. 7 also illustrates the inlet 38 connected to the conduit 11, also shown in dotted line. It is to be understood that any suitable conduits may be associated with the components illustrated in FIG. 7; for example the inlet conduit connected to the inlet 38 may be such as illustrated in said application Ser. No. 08/484,843.

Figure 5:
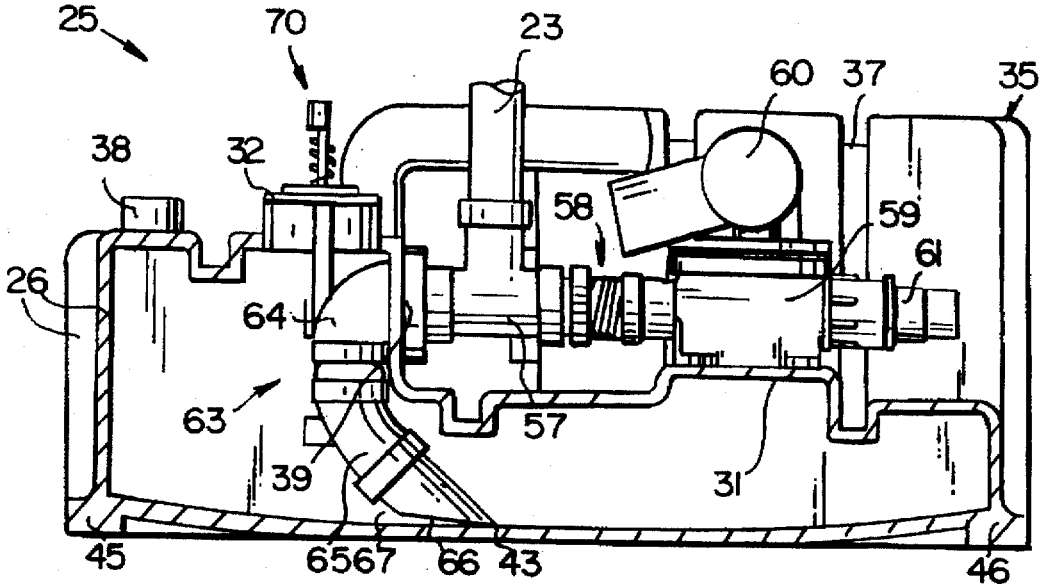
FIG. 5 is a longitudinal view, partly in cross-section and partly in elevation, taken along lines 5—5 of FIG. 4.

FIG. 5 is the opposite side cross-sectional/elevational view of the tank assembly including the tank 25. In this case a connection 58 of conventional construction (e.g. a screw connection, connected through the deck discharge 23 if on a boat) is connected to the first outlet 39 of the tank 25 and a discharge pump 59 is optionally mounted on the surface 31, the pump 59 comparable to the pump 17 in FIGS. 1 and 2 and operated by a motor 60 (such as an electric motor). Where the pump 59 is utilized the discharge outlet 61 therefrom is connected to the conduit 16, but where the pump 59 is not utilized any suitable conduit like the conduit 16 is provided connected directly from the outlet 39 (or the deck discharge 23) to the end termination 19. The end termination 19 may be connected to a suitable pump-out device at a dock, campsite, or the like.

Connected to the first outlet 39 inside the tank 25 is the downwardly extending tube, such as shown generally at 63 in FIG. 5. The tube 63 may have any suitable configuration and that illustrated in FIG. 5 is only exemplary, although a desirable configuration. In this form the tube 63 might be properly characterized as a dip tube assembly including dip tube 64 including a tubular portion 65 that is substantially circular in cross-section and elongated about an axis, and having an open end termination 66 cut at an angle to its axis of elongation and defining a substantially oval-shaped opening which is above but spaced from the vacuum tank 25 bottom adjacent the sump 43. In this way the dip tube assembly 63 is preferably substantially identical to that illustrated in co-pending application Ser. No. 08/484,843.

Figure 6:
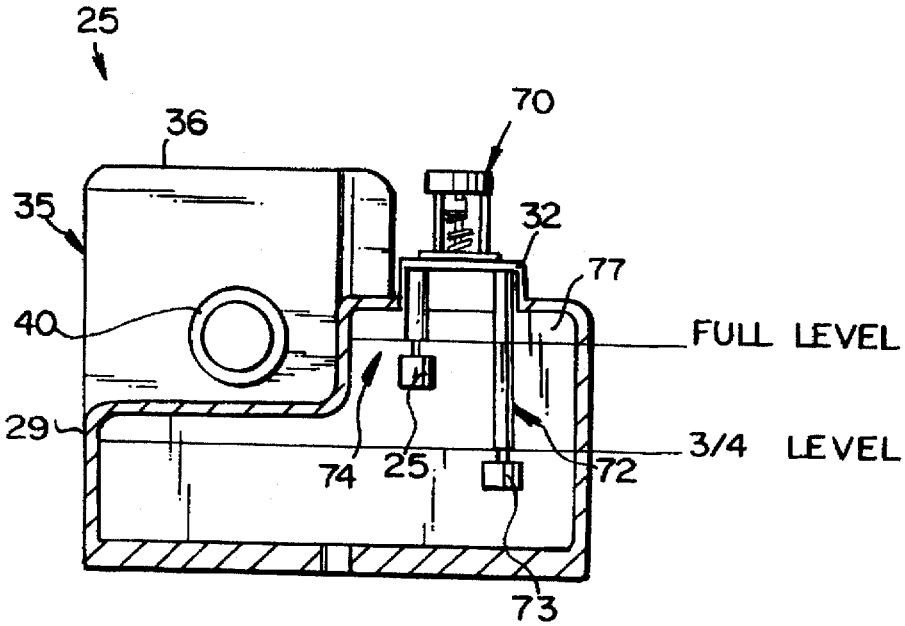
FIG. 6 is an end view, partly in cross-section and partly in elevation, taken generally along lines 6—6 of FIG. 4.

The assembly according to the invention also comprises a conventional vacuum switch 70, which is seen in FIGS. 5 and 6 is typically mounted on the raised surface 32 of the tank 25, adjacent the inlet 38. The vacuum switch 70 may comprise any conventional suitable vacuum switch or like device such as shown in U.S. Pat. No. 4,819,279, which senses the vacuum within the gas volume within the tank 25 and operates the vacuum pump 53 if the level of vacuum falls below a predetermined minimum. As is conventional, the vacuum switch 70 typically senses when the vacuum level has dropped to about eight inches of mercury, and then operates the pump 53 until the level of vacuum is raised to about ten inches of mercury.

The assembly according to the invention also comprises a sensor for sensing the level of liquid (sewage) in the tank 25. Conventional sensors are illustrated schematically at 73 and 74 in FIGS. 6 and 9. In FIG. 6 the sensors 72, 74 are illustrated as conventional float operated sensors, the floats being schematically illustrated at 73 and 75. The sensor 72 and associated float 73 comprise a three-quarters full level indicator (e.g. operating indicator light 79 in FIG. 9), while the sensor 74 and associated float 75 comprise a full level sensor. While mechanical sensors 72, 74 are illustrated in FIG. 6 it is to be understood that any suitable conventional sensor or sensors, whether optical, sonar, piezoelectric, fluidic, or the like, may be provided. Note that the levels of sewage for three-quarter full and full are indicated by reference lines 76 and 77 in FIG. 6.

In a conventional typical system according to the invention, the tank 25 typically has a volume of about ten-fourteen gallons (e.g. 10.6–11 gallons). Typically the full level indicated by line 77 is between about six-eleven gallons (e.g. 7.1–8.0), leaving a gas volume (primarily in the raised portion 35)—and shown by reference numeral 80 in FIG. 7—of between about two and one-half-four gallons (e.g. 3.0–3.5 gallons). Once the full level 77 has been reached—which is far enough below the open top 51 of the gas inlet 48 so that it is unlikely sewage could enter the open end 51—suitable means are provided for precluding operation of the vacuum pump 53, so that a gas volume 80 is always provided adjacent the upper surface 36 inside the tank 25. Such means are schematically illustrated at 81 in FIG. 9. Such means may comprise any suitable conventional means, such as a conventional relay that is opened or dosed to shut off the power (e.g. from a battery or other source of electricity) to the pump 54, or otherwise effectively disable the pump 54 by opening or dosing valves, or the like; or more sophisticated components may be provided such as controllers (like computer controllers), etc. Also the indicator light 79 may light a different color—or an additional indicator light 79 may be provided—when the full level is being indicated as opposed to three-quarters level.

Utilizing the assembly heretofore described a method of operating a vacuum toilet 10 using a combined vacuum and holding 25 connected to the toilet, and a vacuum pump 53 mounted to tank 25, is provided. The method comprises the following steps:

(a) Providing a vacuum in at least an upper gas volume 80 of the tank 25. [Once sewage in the tank 25 has been pumped out, the entire volume thereof (e.g. thirteen-fourteen gallons) is the gas volume at pressure below atmospheric.]

(b) Flushing the toilet 10 (in a conventional manner) so as to connect the toilet to the vacuum in the gas volume 80 so that sewage from the toilet 10 flows into the tank 25, establishing a sewage level (e.g. 76) in the tank.

(c) Sensing (e.g. with vacuum switch 70) the level of vacuum in the tank 25.

(d) When the level of vacuum drops below a predetermined level (e.g. below about eight inches of mercury) as determined by step (c), operating the vacuum pump 53 to raise the level of vacuum above the predetermined level (e.g. up to about ten inches of mercury). When the pump 53 is operating it evacuates gas from the volume 80 by sucking it through the open end 51 of the gas tube 48 so that it passes through the second outlet 40, through the pump 53, and then through the conduit 20' to the end termination 22 in the partition 18.

(e) Sensing (e.g. using sensors 72, 74) the sewage level in the tank 25.

(f) When the sewage level becomes higher than a predetermined mount (e.g. the level 77), precluding operation of the vacuum pump 53 until the sewage level is lowered (e.g. utilizing the means 80, cutting out the supply of electricity or other power source to the motor 54), typically while at the same time indicating this condition (e.g. by energizing indicator light 79).

(g) When necessary, emptying the sewage from the tank 25 directly to a treatment or disposal site, for example either by connecting up the conduit 16 end termination 19 to a pump-out station at a dock or campsite, or by operating the sewage discharge pump 59 motor 60 to pump the sewage so that it flows through dip tube assembly 63 out the first outlet 39 and ultimately through the end termination 19 in the partition 18. Typically the tank 25 is rotational molded from plastic, and step (g) is practiced without applying positive air pressure to the tank 25 interior.

While the invention has been herein shown and described in an eminently suitable embodiment, it will be understood that many modifications and additions can be made thereto. For example equipment for injecting deodorizing chemicals into the tank 25 (either automatically or manually) may be provided, as well as various filters, stabilizing mounting structures, or the like. Therefore it is intended that the invention be given the broadest interpretation of the appended claims so as to encompass all equivalent structures, methods, and procedures.

What is claimed is:

1. A combined vacuum and holding tank assembly comprising:

a substantially hollow tank having first and second ends, first and second sides, at least one pump-mounting surface, first and second outlets, an inlet, a raised portion having an upper surface, and a bottom;

a vacuum pump mounted on said at least one pump-mounting surface exteriorly of said tank;

a downwardly extending tube disposed within said tank connected to said first outlet;

a gas inlet tube disposed within said tank and connected to said second outlet, and having a top open end adjacent said tank upper surface;

a connection between said vacuum pump and said second outlet exterior of said tank;

a sensor for sensing the level of liquid in said tank; and means for precluding operation of said vacuum pump if the sensed level within said tank becomes closer than a predetermined amount to said air inlet tube open top end so that a gas volume is always provided adjacent said upper surface inside said tank.

2. An assembly as recited in claim 1 further comprising a gas discharge tube connected to said vacuum pump for discharging gas from said tank.

3. An assembly as recited in claim 1 further comprising a conduit connected to said first outlet, for discharging sewage from said tank.

4. An assembly as recited in claim 1 wherein said at least one pump-mounting surface comprises a top surface and includes a second pump-mounting top surface; and further comprising a sewage discharge pump mounted on said second pump-mounting top surface and connected to said first outlet.

5. An assembly as recited in claim 1 further comprising a conduit connected to said inlet and to at least one toilet.

6. An assembly as recited in claim 1 wherein said tank is plastic.

7. An assembly as recited in claim 1 wherein said tank is rotational molded from linear low density polyethylene.

8. An assembly as recited in claim 1 wherein said tank has an interior volume of between about 10–14 gallons, and wherein said controller precludes operation of said vacuum pump when the gas volume in the top interior of said tank is below between about 2 and ½–4 gallons.

9. An assembly as recited in claim 1 wherein said first and second outlets are on opposite sides of a vertical plane substantially bisecting said tank and intersecting said first and second ends thereof, and face in opposite directions.

10. An assembly as recited in claim 6 wherein said raised portion has reinforcing grooves formed therein, and has no continuous flat surface area of more than 80 square inches.

11. An assembly as recited in claim 8 further comprising a vacuum switch mounted to said tank for sensing the level of vacuum in said gas volume, and for starting operation of said vacuum pump if the level of vacuum in said gas volume is lower than a predetermined amount.

12. An assembly as recited in claim 1 further comprising a vacuum switch mounted to said tank for sensing the level of vacuum in said gas volume, and for starting operation of said vacuum pump if the level of vacuum in said gas volume is lower than a predetermined amount.

13. An assembly as recited in claim 6 wherein said bottom is formed with a slope toward a sump, and integral plastic legs support said tank on a horizontal surface so that said sump is the lowest part of said tank.

14. An assembly as recited in claim 13 wherein said downwardly extending tube comprises a dip tube having an end termination cut at an angle, defining a generally oval shaped opening disposed adjacent said sump.

15. A method of operating a vacuum toilet, using a combined vacuum and holding tank connected to the toilet, and a vacuum pump, comprising the steps of:

(a) providing a vacuum in at least an upper gas volume of the tank;

(b) flushing the toilet so as to connect the toilet to the vacuum in the upper gas volume so that sewage from the toilet flows into the tank, establishing a sewage level in the tank;

(c) sensing the level of vacuum in the tank;

(d) when the level of vacuum drops below a predetermined level as determined by step (c), operating the vacuum pump to raise the level of vacuum above the predetermined level;

(e) sensing the sewage level in the tank;

(f) when the sewage level becomes higher than a predetermined amount, precluding operation of the vacuum pump until the sewage level is lowered; and (g) when necessary, emptying the sewage from the tank directly to a treatment or disposal site.

16. A method a recited in claim 15 wherein step (d) is practiced to start the vacuum pump when the level of vacuum drops to about 8 inches of mercury, and to stop operation of the vacuum pump once the level reaches about 10 inches of mercury.

17. A method a recited in claim 15 wherein the tank is rotational molded of plastic; and wherein step (g) is practiced without applying positive air pressure to the tank interior.

18. A human waste handling assembly mounted in a boat, plane, train or recreational vehicle having an exterior partition, and comprising:

at least one toilet having a waste discharge therefrom;

a plastic non-cylindrical combined vacuum and holding tank including an inlet and first and second outlets first and second ends, first and second generally planar sides, and a contoured, convoluted, discontinuous surface so that the tank has no continuous flat surface area of more than 80 square inches;

a conduit connecting said tank inlet to said toilet waste discharge;

a vacuum pump connected to said second outlet;

a gas handling conduit from said vacuum pump including an end termination penetrating the boat, plane, train or recreational vehicle exterior partition;

a sewage handling conduit operatively connected to said first outlet and having an end termination penetrating said partition; and said tank having a top and a bottom, sewage from said toilet provided in said bottom, and gas at less than atmospheric pressure provided in said top.

19. An assembly as recited in claim 18 further comprising a discharge pump disposed in said sewage conduit for pumping the sewage from said tank through an end termination in said partition.

20. An assembly as recited in claim 18 wherein said tank is rotational molded plastic, and wherein said vacuum pump is mounted to said tank.

21. An assembly as recited in claim 19 wherein said discharge pump is mounted on said tank.

22. An assembly as recited in claim 20 wherein said vacuum pump includes an inlet mounted within said tank and disposed in a portion of said tank in which gas at less-than-atmospheric pressure is provided at all times.

23. An assembly as recited in claim 22 wherein said vacuum pump inlet includes a generally vertically-extending conduit component having an open top end, said open top end spaced from said tank top from about. 0.1–1.5 inches.

* * * * *